US006389597B1

(12) United States Patent
Henegan

(10) Patent No.: US 6,389,597 B1
(45) Date of Patent: May 21, 2002

(54) HOODED GARMENT FOR DRYING A BABY

(76) Inventor: Kym Henegan, 426 W. Broadway, Apt. 5G, New York, NY (US) 10012

( * ) Notice: Subject to any disclaimer, the term of this patent is extended or adjusted under 35 U.S.C. 154(b) by 0 days.

(21) Appl. No.: 09/902,922

(22) Filed: Jul. 11, 2001

(51) Int. Cl.[7] ..... A41D 11/00; A41B 13/06
(52) U.S. Cl. ..... 2/69.5; 2/75
(58) Field of Search ..... 2/111, 69.5, 75, 2/69, 80, 83, 70, 72, 84, 88, 89, 114; 5/413 R, 494, 655, 417, 419, 420, 482; D2/719; D7/608, 609, 597, 598, 596

(56) References Cited

U.S. PATENT DOCUMENTS 2,242,641 A * 5/1941 Berger ..... 2/111
2,374,299 A * 4/1945 O'Hara ..... 2/69.5
3,412,407 A * 11/1968 Key ..... 2/69.5
4,616,365 A * 10/1986 Lyons ..... 2/69.5
4,790,040 A * 12/1988 Grilliot et al. ..... 5/413 R
D305,844 S * 2/1990 Chang ..... 2/69.5
4,897,885 A * 2/1990 Lunt ..... 2/69.5
5,046,204 A * 9/1991 Mohler ..... 2/69
5,131,096 A * 7/1992 Olson ..... 2/69
5,321,863 A * 6/1994 Yamaguchi et al. ..... 2/69.5
5,535,449 A * 7/1996 Dickey ..... 2/69
D380,589 S * 7/1997 Westman ..... D2/719
6,341,397 B1 * 1/2002 Kliegl et al. ..... 2/69.5

* cited by examiner

*Primary Examiner*—Amy B. Vanatta
(74) *Attorney, Agent, or Firm*—Levisohn, Lerner, Berger & Langsam

(57) ABSTRACT

A hooded towel is a garment/gown for a baby after bathing that provides for drying and for warmth. The towel has a bottom closure and overlapped front panels or lapel-shaped sections which provide an opening through which the baby may be placed. The panels extend over the front of the baby to keep the baby warm. The panels will not open even if the baby squirms and moves about. A hood covers the baby's head.

21 Claims, 3 Drawing Sheets

HOODED GARMENT FOR DRYING A BABY

FIELD OF THE INVENTION

The present invention relates to a hooded, baby-drying, soft and absorbent towel. The device is made with overlapping front panels and a closed bottom. It is intended to be used to dry a baby after bathing. More particularly, the present invention relates to a hooded towel with overlapping front panels or flaps and a closed-off bottom that would typically be provided to dry a baby and keep the baby warm after bathing the baby.

BACKGROUND OF THE INVENTION

A hooded towel with an open bottom is known in the art to dry a baby. In such a hooded towel, the hood is commonly formed in one corner of an otherwise rectangular terry cloth and the three non-hooded free corners are foldable over the baby. Thus, the baby's head may be placed within the hood portion of the towel and the remainder of the towel may be folded, bottom up first, then the sides, one overlapping the other around the baby. The hooded towel with three open corners has the disadvantage that the care giver must manipulate and wrap the towel around the baby. Also, the towel is not secured to stay wrapped around the baby so that baby wriggling can easily unwrap the baby. Clearly, this is undesirable.

It is also known to provide a bunting or a large, warm woolen or similar material papoose with attached hood as a garment for a baby to wear to keep the baby warm. Bunting is, however, not known to be used for drying a baby. The bunting is often provided with a zipper or other mechanical closure, running down its middle to open and close it. However, the use of a zipper may be inconvenient to the care giver who may require two hands to operate the zipper. Also, the zipper of these warm, woolen buntings, not meant for drying a naked baby, may be abrasive against a baby's skin.

The prior art does not simultaneously provide for a hooded soft and water absorbent cloth with a closure at the bottom, which allows quick baby covering through overlapped front panels that may be easily spread apart for baby "insertion" but, then, after the baby is within the cloth, the overlapped lapels maintain the baby closed within. There is a need to provide for a baby gown that may be worn by a baby after bathing that allows the care giver to easily and conveniently dry, dress and warm the baby, which will not easily unfold by a squirming baby placed therein. Also, elimination of an abrasive zipper or other mechanical closure while providing an "automatic" closure feature of mere overlapped cloth panels is a desirable object.

SUMMARY OF THE INVENTION

The invention relates to a baby towel that may be worn as a gown and which may be used for quickly drying and warming a baby. More specifically, the invention relates to a one-corner hooded baby towel or gown that opens and closes in the front by overlapped panels and which is sewn, hemmed or otherwise closed off at the bottom.

Accordingly, it is an object of the invention to provide for a hooded, closed-bottom towel or gown that may be used for drying a baby.

It is a further object of the invention to provide for a hooded, closed-bottom baby towel or gown that allows for both drying and warming the baby after a bath.

It is a further object of the invention to provide for a hooded, closed-bottom baby towel or gown that opens and closes in the front by overlapped panels and which is closed at the bottom but which does not open merely upon baby squirming.

Other objects advantages and features of this invention will become more apparent hereinafter.

BRIEF DESCRIPTION OF THE DRAWINGS

The present invention will now be described with reference to the accompanying drawing figures, in which.

DETAILED DESCRIPTION OF THE PREFERRED EMBODIMENT AND THE DRAWINGS

Figure 1:
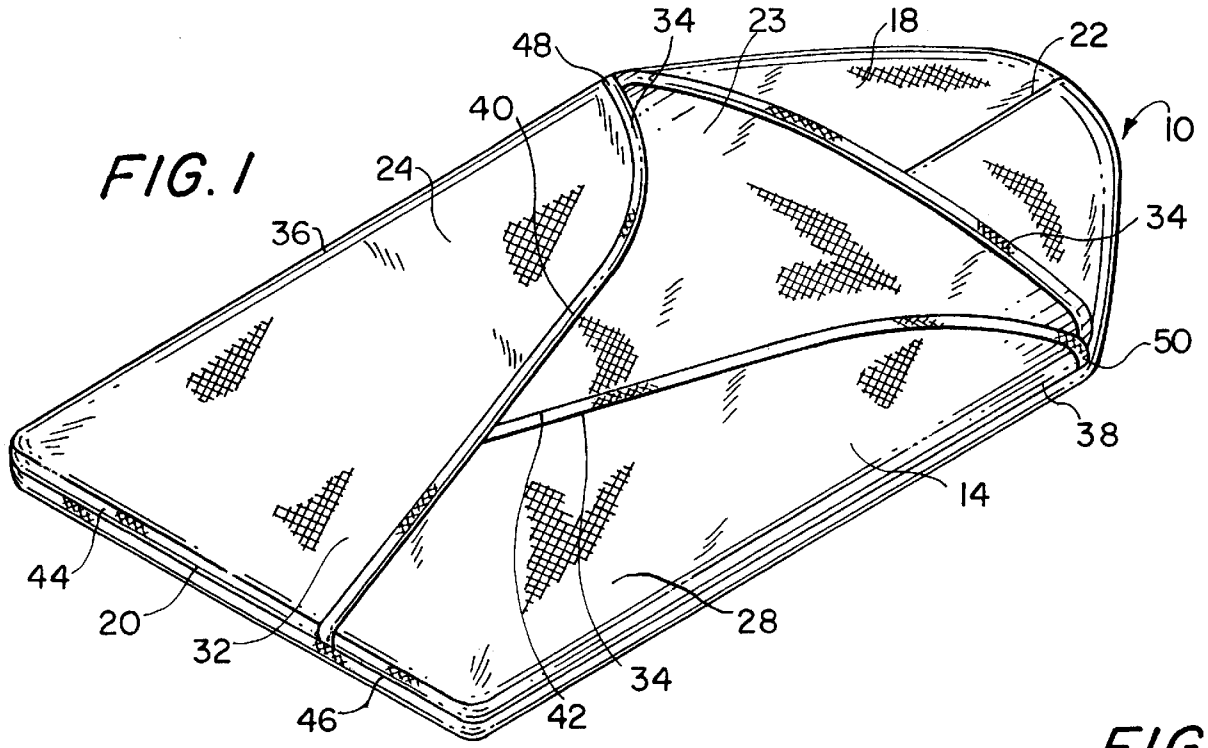
FIG. 1 is a top, rear and right side perspective view of an embodiment of the present invention.
Figure 2:
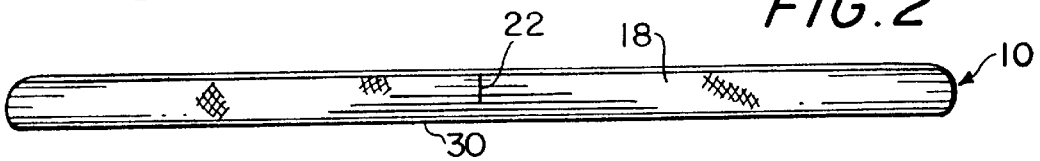
FIG. 2 is a front view of the embodiment of the present invention shown in FIG. 1.
Figure 3:
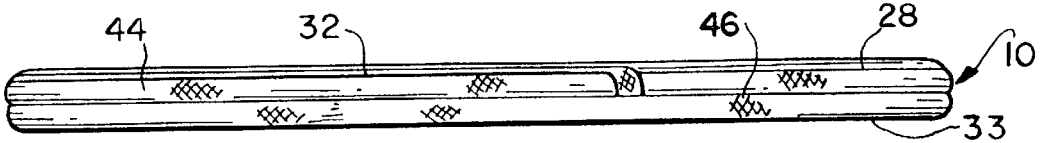
FIG. 3 is a rear view of the embodiment of the invention shown in FIG. 1.

Turning initially to FIG. 1, there is illustrated a top, rear and right side perspective view of an embodiment of the one-corner, hooded, bottom-closed towel or baby garment 10. The garment 10 comprises a body portion 14 and a hood section 18. The towel or garment 10 is preferably made from soft, water absorbent terry cloth material. In the preferred embodiment, the inside surface of the garment 10 is terry-cloth or cut-loops with the outside surface smoother cloth or closed loops. The hood 18 is connected, indeed, is an integrated extension to body portion 14. An opening is formed in the front of the towel 10 by overlapped panels or lapels 24 and 28. The backside of the body portion 14 is contiguous with the rear of the hood 18. The body portion 14 is closed or seamed at the bottom edge 20.

Figure 7:
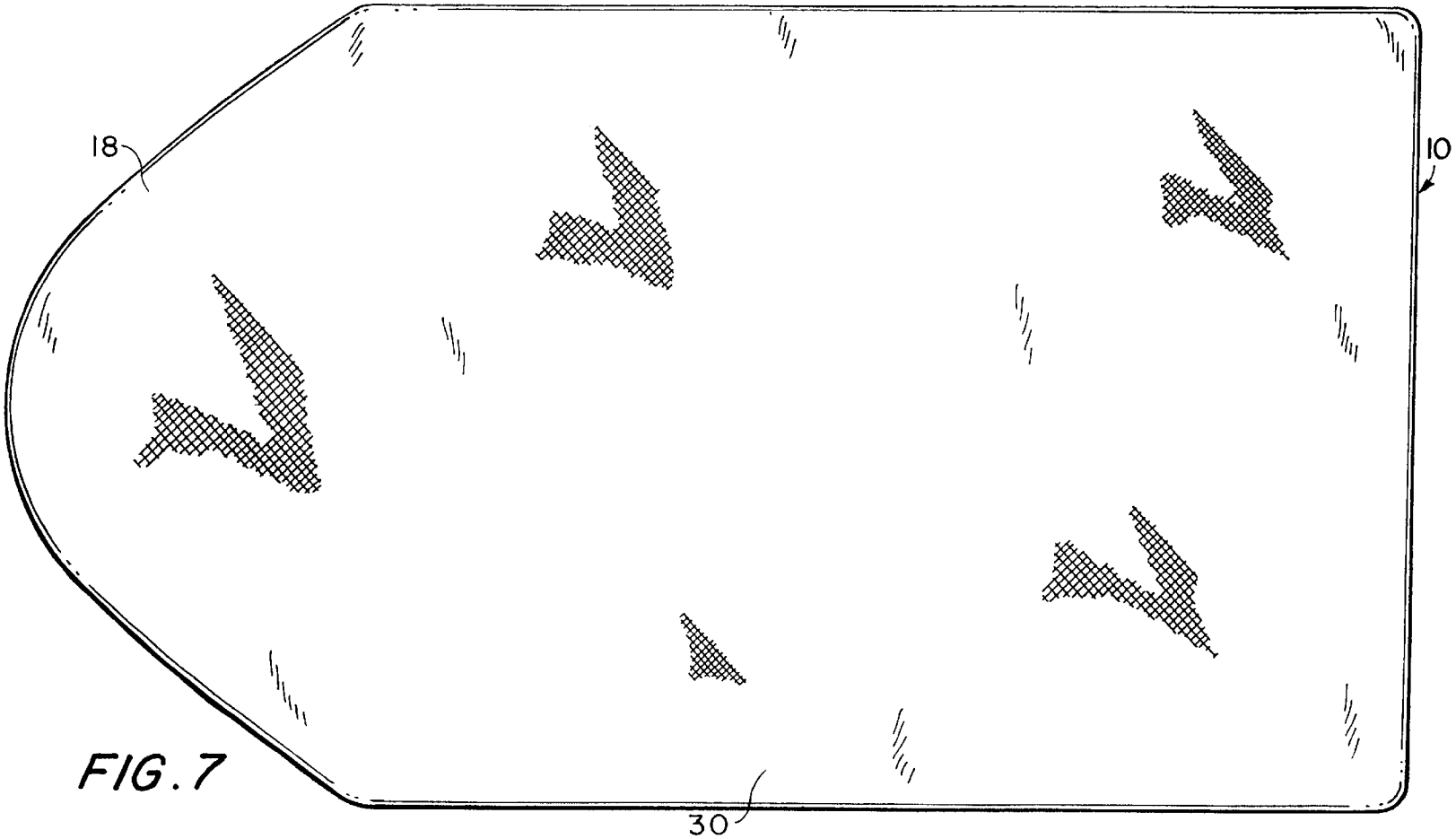
FIG. 7 is a bottom plan view of the embodiment of this invention shown in FIG. 1.

The body portion 14 may be formed of a back portion or a rear section 30 (see FIG. 7) a left panel 24 and a right panel 28 (from the care giver's perspective). In one embodiment, a left panel 24, a separate piece of cut material, is sewn at a left-side seam 36 to the left side of rear section 30 and a right panel 28, also a separate panel, is sewn to the right side of rear section 30 to form a right seam 38. A garment pattern maker can, however, cut the rear section and left and right panels as a single piece of material and form the garment by appropriate cutting, seaming, pressing and/or tucking. The right panel 28 may be sewn at its bottom 46 to the foot-end of body portion 14 to form a seam that forms a portion of bottom seam 20. The left panel 24 may be partially overlapped over and extended on top of right panel 28. Then, the left panel 24 may also be sewn at its bottom 44 to the foot-end of the body portion 14 and through the overlapped portion of bottom 46 of the right panel 28 to form a seam that forms the remaining portion of bottom seam 20. In this way, left panel 24 has been sewn at a portion of its bottom 44 to right panel 28 at a portion of its bottom 46, such that left panel 24 will partially overlap on top of right panel 28. In a preferred embodiment, approximately one-half of the bottom 44 of left panel 24 is sewn to approximately one-half of the bottom 46 of right panel 28, so that an area of overlap 32 is formed. In this manner, the towel 10 is closed at its bottom and two overlapping panels 24 and 28 provide an openable enclosure for a baby, along with the hood, for drying.

Left panel 24 may be formed with a substantially straight bottom 44 that is substantially perpendicular to the left seam 36 or edge. Left panel 24 may have a curved lapel edge 40, so that left panel 24 is substantially wider at the bottom of the left seam 36 than at the apex 48 of the left seam 36. Thus, the left panel may be substantially right-triangular-like in shape with the hypotenuse edge slightly curved.

Right panel 28 may have the same general shape and size as left panel 24. Right panel 28 may be formed with a substantially straight bottom 46 that is substantially perpendicular to the right seam 38, and right panel 28 may have a curved lapel edge 42, so that right panel 28 is substantially wider at the bottom of the right seam 38 than at the apex 50 of the right seam 38. Thus, right panel may also be substantially right triangular-like in shape, with the hypotenuse edge slightly curved. The "hypotenuse" yet curved edges can be finished with colorful ribbon or other fabric.

The towel 10 extends behind the back of the baby so that the gown has no opening in the back, is closed at the bottom and is partially open in the front. The towel 10 has an open front, which will tend to close by placing a baby within the towel such that left panel 24 partially overlaps right panel 28. Thus, when a baby is placed in the towel, the baby may by placed through the front opening 23 so that the baby's head is within the hood 18, the baby's legs extend toward the bottom seam 20, behind the left and right panels, and the posterior of the baby is covered by the rear of the body portion of the article. An area of overlap 32 is formed in the front of the body portion 14. When the baby is so situated, the baby's physical dimensions are such that the left lapel holds the right lapel at the overlapped section, inhibiting unintentional uncovering of the baby. Attractive trimming may be attached to the free edges 34 of the lapel panels and to the edge of the hood.

In the preferred embodiment, the point of overlap 52 (see FIG. 4) is about ⅔ of the distance of the side edges 36 and 38 or about ⅔ of the height of the side edges of the right and left panels, so, in a device where the length of the side edges or seams 36 and 38 is about 21", the point of overlap 52 extends from the bottom 20 to about 12–13" from bottom edge or seam 20. Of course, the geometry can be adjusted of the fabric pieces to provide more or less overlapped material.

Figure 4:
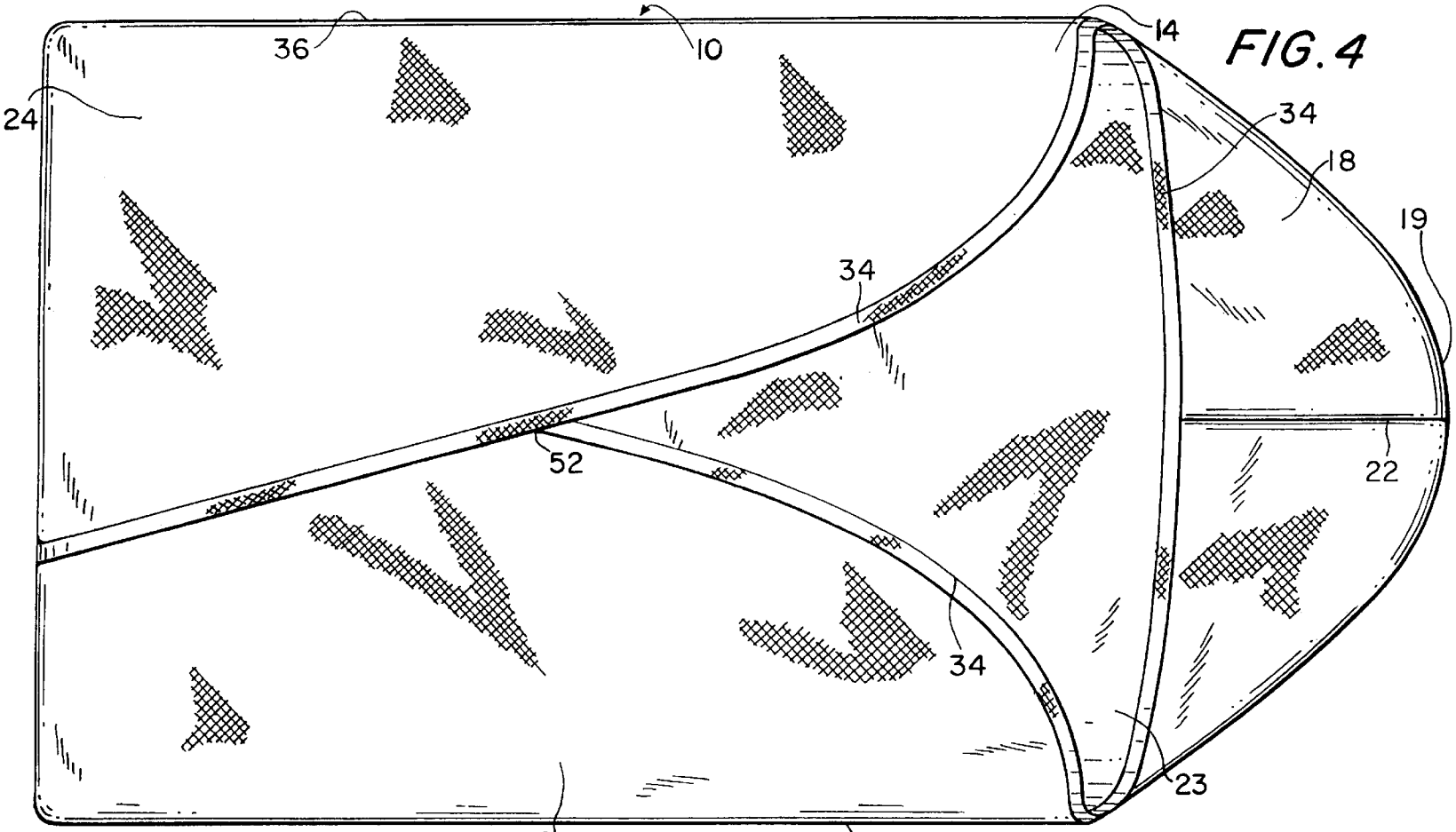
FIG. 4 is a top plan view of the invention.
Figure 5:
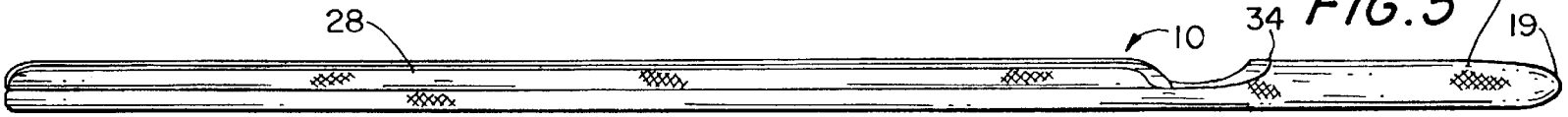
FIG. 5 is right side view of the embodiment of this invention shown in FIG. 1.
Figure 6:
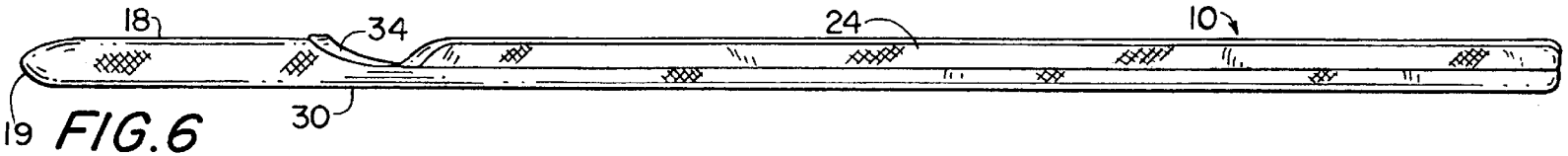
FIG. 6 is left side view of the embodiment of this invention shown in FIG. 1.

As shown in FIG. 4, in a preferred embodiment the hood is formed by a top, centered seam 22. A front seam 19 at the front edge may also be used. Together these form a holding and secure "pocket" for placement of the baby's head.

The gown 10 is made of water absorbent material, preferably such as cotton or a cotton and polyester mixture. For example, 75% cotton and 25% polyester may be used to form the body and hood of the gown, while 44% cotton and 56% polyester may be used to form the trim of the gown, although the percentages of cotton and polyester are not critical, as long as a water absorbent material is used for the inside sections of the gown.

In a preferred embodiment the inside of the gown 10 is made of multiply looped cotton, terrycloth, to increase its water absorbency. The outside of the gown 10 may be made of smoother fiber than the interior of the gown 10. Thus, in use, the care giver may simply dry the baby by placing the baby within the gown 10, by slipping the baby into the center opening, allowing left front panel 24 to overlap right front panel 28 and gently patting the baby dry. The baby's presence tends to maintain closure of the panels over the baby.

Writing or other decorative features may be sewn into, embroidered on or attached to the gown. The gown may be manufactured in different sizes. The gown should be appropriately sized in length to accommodate babies and infants of different ages and sizes. The panels should be appropriate sized in width to provide a sufficient overlap of fabric in front. Since the posterior of the baby is not accessible when placed in the gown 10, the baby is kept warm and covered after bathing.

Having described this invention with regard to specific embodiments, it is to be understood that the description is not meant as a limitation since further modifications and variations may be apparent or may suggest themselves to those skilled in the art. It is intended that the present application cover all such modifications and variations as fall within the scope of the appended claims.

I claim:

1. A pouch-like garment for drying a baby comprising:

a back panel having a top edge and an opposed bottom edge and a pair of opposed side edges;

a first, basically right-triangular-shaped, panel having a pair of perpendicular edges and a hypotenuse edge;

and a second, basically right-triangular-shaped, panel also having a pair of perpendicular edges and a hypotenuse edge;

a first of said perpendicular edges of said first panel connected to a first of said opposed side edges of said back panel and a first of said perpendicular edges of said second panel connected to the second of said opposed side edges of said back panel, wherein at least a portion of the hypotenuse edge of one of said first panel and said second panel overlaps at least a portion of said hypotenuse edge of the other of said first panel and said second panel such that one of said first and second panels at least partially overlaps said other of said first and second panels and at least a portion of said back panel, and wherein the second perpendicular edges of both said first and second panels are secured to said bottom edge of said back panel.

2. A garment as claimed in claim 1, further comprising a hood section extending from said top edge of said back panel.

3. A garment as claimed in claim 1, wherein both of said pairs of perpendicular edges of said first and second panels are seamed to said back panel.

4. A garment as claimed in claim 1, wherein said first of said pairs of perpendicular edges of said first and second panels are continuous fabric extensions of said back panel.

5. A garment as claimed in claim 2, wherein said hood section is a continuous fabric extension of said back panel.

6. A garment as claimed in claim 1, wherein said hypotenuse edge of a first of said first and second panels overlaps the other hypotenuse edge of the first and second panels at a point from said bottom edge of said back panel about ⅔ of the length of the side edges of said back panel.

7. A garment as claimed in claim 1 wherein both of said hypotenuse edges of said first and second panels are provided with a finished, decorative edge.

8. A garment as claimed in claim 1 wherein said hypotenuse edges of said first and second panels are provided with a curved section.

9. A garment as claimed in claim 1 wherein said back panel is made front water-absorbent material.

10. A garment as claimed in claim 1 wherein said back panel and said first and second panels are made from water-absorbent material.

11. A garment as claimed in claim 2 wherein said hood section is made from water-absorbent material.

12. A garment as claimed in claim 2 wherein said back panel and said hood section are made from water absorbent material.

13. A garment as claimed in claim 2 wherein said back panel, said hood section and at least one of said first and second panels are made from water-absorbent material.

14. A garment as claimed in claim 2 wherein said back panel, said hood section and both said first and second panels are made from water-absorbent material.

15. A baby drying, pouch-like garment comprising:

a back panel having two opposed side edges, a top edge and a bottom edge basically perpendicular to said opposed side edges;

a first lapel-shaped panel extending from a first of said side edges;

a second lapel-shaped panel extending from a second of said side edges;

said first and second lapel-shaped panels overlying said back panel;

wherein one of said first and second lapel-shaped panels overlies a portion of the other of said first and second lapel-shaped panels and wherein the bottom edge of one of said first and second lapel-shaped panels overlies the bottom edge of the other of said first and second lapel-shaped panels and wherein said bottom edges of said first and second lapel-shaped panels are permanently fixedly secured to said bottom edge of said back panel.

16. A garment as claimed in claim 15 wherein a first of said first and second lapel-shaped panels overlaps at least a portion of the other of said first and second lapel-shaped panels.

17. A garment as claimed in claim 16 wherein said first and second lapel-shaped panels are continuous fabric extensions from said side edges of said back panel and said first and second lapel-shaped panels are seamed to said bottom edge of said back panel.

18. A garment as claimed in claim 15 wherein said back panel, first and second lapel-shaped panels are made from water-absorbent material.

19. A garment as claimed in claim 15 further comprising a hood section extending from said top edge of said back panel.

20. A garment as claimed in claim 16 wherein a first of said first and second lapel-shaped panels overlaps at least a portion of the other said first and second lapel-shaped panels.

21. A garment as claimed in claim 20 wherein said overlap extends from said bottom edge of said back panel to a point about ⅔ of the length of said opposed side edges.

* * * * *